United States Patent [19]

Armstrong

[11] 4,228,999

[45] Oct. 21, 1980

[54] SOMERSAULT SWING

[76] Inventor: W. Ted Armstrong, P.O. Box 40962, San Francisco, Calif. 94140

[21] Appl. No.: 951,163

[22] Filed: Oct. 13, 1978

[51] Int. Cl.[3] ..... A63G 1/20

[52] U.S. Cl. ..... 272/33 R; 272/49; 272/115

[58] Field of Search ..... 272/33 R, 1 B, 1 R, 272/56, 85, 87, 30, 38, 49, 62, 109, 115, 50; 280/206, 207, 208

[56] References Cited

U.S. PATENT DOCUMENTS

| | | | |
|---|---|---|---|
| D. 190,038 | 4/1961 | Nickell, Jr. et al. | 280/207 U X |
| 1,521,133 | 12/1924 | Tinker | 272/1 R X |
| 2,838,022 | 6/1958 | Wilson | 272/115 X |
| 3,088,732 | 5/1963 | Hetland | 272/1 B |
| 3,117,780 | 1/1964 | Gregory | 272/56 |
| 3,119,612 | 1/1964 | Whitson | 272/49 X |
| 3,127,169 | 3/1964 | Guihan | 272/33 R |
| 3,207,508 | 9/1965 | Klemke | 272/33 R X |
| 3,212,790 | 10/1965 | Burling | 272/33 R X |
| 3,575,443 | 4/1971 | Aguilar | 272/33 R X |

FOREIGN PATENT DOCUMENTS

| | | | |
|---|---|---|---|
| 98164 | 3/1964 | Denmark | 272/1 B |
| 1258155 | 2/1961 | France | 272/1 B |
| 374316 | 2/1964 | Switzerland | 272/49 |

*Primary Examiner*—Richard C. Pinkham
*Assistant Examiner*—Arnold W. Kramer

[57] ABSTRACT

This device consists primarily of a pair of parallel spaced-apart sides, which are arcuately curved on the bottom, so as to be in rocking-like engagement with a ground, or floor, surface. The device includes, in the upper portion, between the sides, a rotatable member, upon which a person stands and holds onto, for effecting a somersault motion, and the device further includes a transverse member on each end of the sides, so as to enable the person using it, to somersault safely.

5 Claims, 2 Drawing Figures

FIG. 1
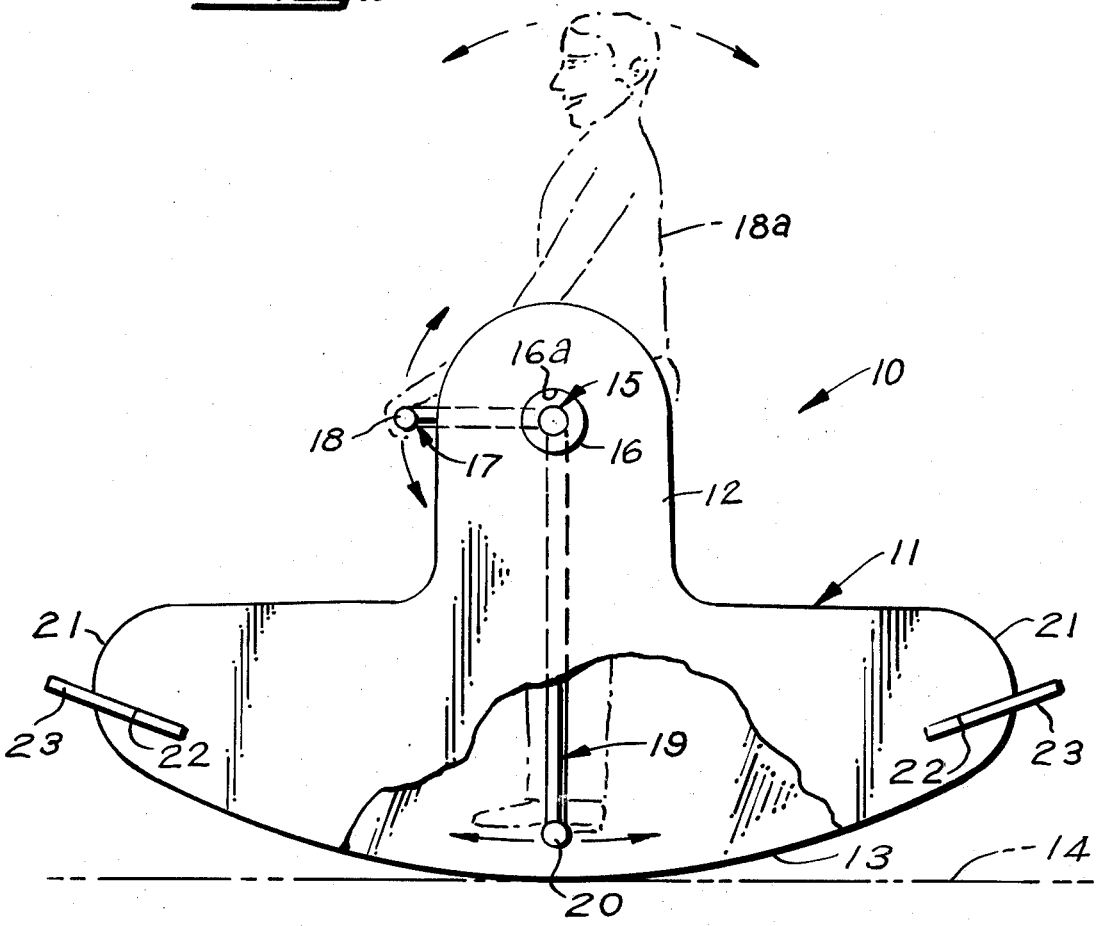
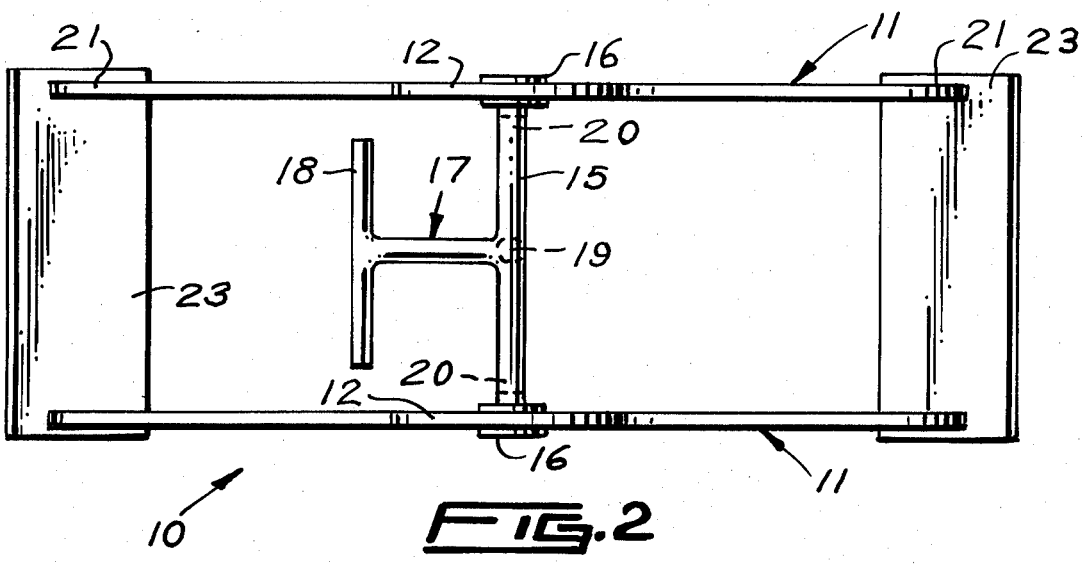
FIG. 2

SOMERSAULT SWING

This invention relates to gymnastic devices, and more particularly, to a somersault swing.

It is, therefore, the principal object of this invention to provide a somersault swing, which will be unique and novel, in that it will enable a person to execute, vertically, a three hundred and sixty degree turn, either forwardly, or backwards.

Another object of this invention is to provide a somersault swing, which will enable anyone to somersault safely, without accident.

A further object of this invention is to provide a somersault swing, which will have a pivotal member in between the sides of the structure, so as to enable a person to stand thereon, while holding onto the top bar portion, so as to enable the person to execute a somersault.

Other objects of the invention are to provide a somersault swing, which will be simple in design, inexpensive to manufacture, rugged in construction and easy to use.

These, and other objects of the invention, will become readily evident, upon a study of the specification, and the accompanying drawing, in which:

FIG. 1 is a side view of the present invention, shown partly broken away, and illustrates a person standing therein, in phantom lines, and FIG. 2 is a top plan view of FIG. 1, showing the figure of a person removed therefrom.

According to this invention, a somersault swing 10 is shown to include a pair of parallel spaced-apart sides 11, which includes a central upper portion 12, fixedly connected therewith, and the bottom surfaces 13 are arcuate, so as to enable swing 10 to rock on floor, or ground surface 14. A shaft 15 is journaled, at each end, in bearings 16, which are secured within the openings 16*a*. The "T"-shaped handle 17 is fixedly secured, at one end, to the center of shaft 15 at its outer periphery, in a suitable manner, and the ends 18 serve as handle grip means for the person 18*a*, using swing 10. An elongated "T"-shaped bar 19 is fixedly secured, in a suitable manner, to the outer periphery of the center of shaft 15, and the ends 20 serve as foot rest means for the person 18*a*. Bar 19 is at right angles to "T"-shaped handle 17, and shaft 15 is freely rotatable within bearings 16, so as to enable the person 18*a* to rock swing 10, until enough inertia is attained, after which, a person will be able to effect a complete somersault, either forward, or backwards.

It shall be noted, that, at the ends 21 of sides 11, is an opening 22, in which is fixedly secured, an angularly disposed panel of rectangular configuration, which serves as stop means against the floor, for safety, when swing 10 is being rocked by the person 18*a*.

While various changes may be made in the detail construction, it is understood that such changes will be within the spirit and scope of the present invention, as is defined by the appended claims.

What I now claim is:

1. A somersault swing, comprising, in combination, a pair of parallel spaced-apart side members each with an arcuate bottom rocking surface, for rocking engagement with a floor or ground surface, a shaft rotatably received in said pair of parallel spaced-apart side members and extending therebetween, with a horizontal and "T"-shaped handle secured thereto, and a "T"-shaped foot rest bar secured to said shaft, for the person using said swing to stand upon with his hands grasping the handle whereby on sufficient rocking the person may rotate about the shaft.

2. The combination according to claim 1, wherein said pair of parallel spaced-apart side members each include a central and upper portion, fixedly connected therewith, and said shaft ends are rotatably journaled within a bearing in each of said central and upper portions.

3. The combination according to claim 2, wherein said horizontal "T"-shaped handle is fixedly secured at one end to the center and outer periphery of said shaft and the oppositely opposed ends serve as handle grips for the user of said swing.

4. The combination according to claim 3, wherein said "T"-shaped footrest bar is fixedly secured at one end to the center and outer periphery of said shaft, at right angles to said horizontal "T"-shaped handle, and said "T"-shaped footrest bar depends downward between said pair of parallel spaced-apart side members, the oppositely opposed ends providing support for the user's feet.

5. The combination according to claim 4, wherein the ends of said parallel spaced-apart side members each include an angularly disposed slot, in which is fixedly secured a rectangular panel bridging each end of the swing and said rectangular panels project from said ends and the outside surfaces of said pair of parallel spaced-apart side members, the longitudinal side edge of said projecting panels forming stop means against the floor, so as to prevent over-rocking said swing when excessive inertia is created by the user.

* * * * *